United States Patent [19]

Benardelli

[11] Patent Number: 5,033,774

[45] Date of Patent: Jul. 23, 1991

[54] PLASTIC SAFETY CASE FOR ENSURING THE AUTHENTICITY AND CONDITION OF A GOLD COIN, PRECIOUS STONE, PEARL OR THE LIKE

[75] Inventor: Giovanni Benardelli, Coldrerio, Switzerland

[73] Assignee: Arysearch Arylan AG, Vaduz, Liechtenstein

[21] Appl. No.: 258,786

[22] Filed: Oct. 17, 1988

[30] Foreign Application Priority Data

Jun. 10, 1988 [CH] Switzerland ..... 2214/88

[51] Int. Cl.[5] ..... A45C 11/24; B42C 15/00

[52] U.S. Cl. ..... 283/108; 206/807; 206/0.82; 206/0.83

[58] Field of Search ..... 206/0.8, 0.81, 0.82, 206/0.83, 0.84, 807; 283/108

[56] References Cited

U.S. PATENT DOCUMENTS

| | | | |
|---|---|---|---|
| 4,488,646 | 12/1984 | McCorkle | 206/0.82 X |
| 4,592,465 | 6/1986 | Stein | 206/0.83 |
| 4,834,552 | 5/1989 | Makowka | 206/807 X |
| 4,838,708 | 6/1989 | Holcomb et al. | 206/807 X |

FOREIGN PATENT DOCUMENTS

| | | | |
|---|---|---|---|
| 2257225 | 5/1974 | Fed. Rep. of Germany | 206/0.82 |
| 7523961 | 7/1975 | Fed. Rep. of Germany . | |
| 8123255 | 4/1982 | Fed. Rep. of Germany . | |

*Primary Examiner*—Paul A. Bell

*Attorney, Agent, or Firm*—Scully, Scott, Murphy & Presser

[57] ABSTRACT

A case of plastic material for at least one marketable valuable piece as a coin, a medal, a precious stone, a pearl, a stamp or the like, including two superimposed elements, at least one of which is transparent and formed with a shell to lodge the piece. The elements are connected at least along their edges, and between the upper and lower elements which enclose the piece with certification data, a tamperproof seal is provided against counterfeiting and against forced opening. The seal includes a delaminable security printing pattern in the form of a hologram or of a multi-ink layer which is discontinuously adhered so as to be visibly and irreparably lacerated upon an opening attempt being imparted to the case.

8 Claims, 3 Drawing Sheets

PLASTIC SAFETY CASE FOR ENSURING THE AUTHENTICITY AND CONDITION OF A GOLD COIN, PRECIOUS STONE, PEARL OR THE LIKE

BACKGROUND OF THE INVENTION

1. Field of the Invention

The present invention relates to containments for coins, medals, ingots and like articles constituted of precious metals, as well as for precious stones, pearls or stamps of philatelic value; and more specifically, relates to a safety case incorporating a protective device enabling certification of the authenticity and mint condition of the contained item. Coins, medals and the like which are struck from gold, silver or platinum have always been purchased by collectors, especially when there is a rise in the quotation as to the price of the metal in question, for their maintenance in private collections, with the possibility that these coins and medals may later on be put up for sale when their quotation affords for the making of an appreciable profit. The foregoing also applies not only to the trade or sale of ingots, generally of gold or platinum, but also of precious stones and pearls and to the sale of stamps possessing an intrinsic philatelic value.

The vast majority of these transactions causes considerably difficulties, because it is necessary to initially investigate, for each single item of sale, the characteristics or properties thereof; in effect, numismatic or philatelic, which are set forth not only by the seller but also resulting from the legend on the coin, medal, ingot or the like, or on the stamp. For instance, these characteristics may be the metallic composition and content, size, dating, weight, face value, and grading; as well as the denomination of the coin, medal, ingot and the like. Thus, for coins it is necessary to check, inter alia, whether the precious metal item has or not lost, to any appreciable extent, its mint bloom, which is peculiar to a freshly struck or similarly produced piece. It is known that, in conformance with subjective standards, the absence of scratches, bag marks and the like, or of other disqualifying or value-lowering wear marks resulting from circulation, must be ascertained on the obverse and reverse side of each piece. Obviously, a high quality is guaranteed at the time of issue for all pieces by the mint or precious metal foundry, or at least by the dealer, as the first seller to the public, which seller is usually either a bank or a numismatic association. However, with the successive circulation, such a guarantee of authenticity and mint condition is obviously lost, on the one hand, because circulation offers an opportunity to potentially dishonest people to circulate counterfeits or pieces possessing lesser values than those indicated in the legend, and on the other hand, because most pieces, even if made from the original material, already evidence aesthetic blemishes from wear and handling as a result of their circulation.

2. Discussion of the Prior Art

Consequently, the need for accurate, although subjective, preliminary inspection of each piece results in a slowdown in sales or trade transactions, which cannot be carried out within realistic or practical time periods due to price variations, and upon occasion, potential purchasers are discouraged from acting on the fluctuating market because of the excessively time-consuming controls employed after the initial offer. Up to the present, a single coin, medal, ingot or the like of precious metal such as gold, silver and platinum, was usually contained within a cover or closure of plastic sheeting, formed by two superimposed elements, at least one of which was transparent for visual access to the interposed piece, the elements being bonded at least along their edges so as to enclose the piece from the time of its coinage or production, or at least from its first sale to the public. Even if the cover containing the coin, medal or ingot was applied from the time of the coinage or production, or first sale to the public, this would not represent a guarantee as to the origin and authenticity of the piece, inasmuch as the latter could have been easily replaced in the cover due to the absence of any valid seal or of impregnable security elements, and because the cover could be opened in a non-destructive manner, with the always potential substitution of the original piece contained therein. Such a cover, even if properly sealed, was always subject to the suspicion that a forced opening had already occurred, with the consequent necessity of opening the same for a direct investigation of the piece prior to its purchase.

In order to eliminate the above-mentioned disadvantages, and to provide for the safeguarding of a security case or receptacle; the latter may be provided with a device, adapted to expose in an immediate, assured and permanent manner any opening or attempted opening thereof at any location on the case, so as commencing from the time of issue the guarantee of origin by the agency effecting coinage or preparation of the piece or item, or at least by the first dealer, as well as the original mint condition or quality of preparation, may be permanently ensured for each piece which is circulated within such an intact case.

SUMMARY OF THE INVENTION

According to the present invention, the case or receptacle is constituted from two superimposed elements which are bonded together, preferably from a sheet-like and transparent plastic material, and wherein at least one of the elements, preferably the upper one, is provided with at least one housing in the form of a compartment for the receipt of a single piece; and the other, generally flat, element, in effect, the lower one, incorporates also by transparency, an indelible graphic pattern consisting of images and data for the identification and the certification of the piece. Moreover, provision is made between the two superimposed elements enclosing the piece, in order to impart a tamperproof seal which not only secures against counterfeiting but also against forced opening, for an imprinted decorative layer which represents a security printing pattern, which is discontinuously anchored to its support and is therefore delaminable, with a visible irreparable laceration of the security printing pattern being produced as soon as an attempt at opening is carried out on - TM the case; this intermediate layer, with the appropriate printing spare about the piece, being also bonded with the two elements at least along their respective edges, thereby forming, because of the anchoring and bonding effect, a permanent unit therewith.

In actual practice, the seal in the form of a security printing pattern which is provided as a protection against counterfeiting is made of a holographic microembossed metallized coating, which is loosely anchored to a specific substrate constituted of a sheet of plastic material and is therefore delaminable; the coating with the substrate being bonded by means of an adhesive to both elements of the case, and is delaminated with a visible irreparable laceration of the security printing pattern upon the exertion of any pulling action against the overlying adhesive as soon as an attempt at opening is carried out on the case.

Alternatively, the counterfeiting-protective seal in the form of a security printing pattern is a decorative multi-ink layer, which is anchored with only some portions thereof to its substrate element due to the application of a previous coating of a transfer primer on the remaining portions, and is consequently delaminable. This layer is bonded to the other element by means of an adhesive, so that when delaminated it produces a visible irreparable laceration of the security printing pattern in response to the pulling action of the overlying adhesive as soon as an attempt at opening is carried out on the case.

The security printing pattern may consist of a figure, a sign, a writing, a letter, a number or the like, and may also be produced from a combination of the foregoing indicia or symbols, or by their random association.

In general, the two elements forming the case are transparent in nature. However, it is possible that one of the elements may be opaque, particularly in relation with the nature of the piece contained in the case; for instance, a stamp, in which only one face thereof discloses the characterizing features.

The transparent lower element may possess a graphic pattern analogous to those of conventional credit cards, and may have a shape in conformance with such cards. Moreover, the upper element may also have a shape in conformance with that of credit cards.

The upper element can be thermoformed from a plastic sheet material such that the housing consists of a thermoformed relief. The same result can be obtained by blistering the element under a vacuum while it is superimposed on the lower element with the piece or item disposed therebetween.

The two elements can be constituted of any transparent plastic material which is suitable for this purpose; and particularly expedient is the use of a plastic material selected from the group consisting of polyvinyl chloride, polystyrene, polyester, polycarbonate, polypropylene, and polyethylene.

The lower element may possess the shape of a small tray, namely provided with a peripheral rim, and with the housing for the piece then not being in relief or profile, inasmuch as it is obtained as a niche in the bottom wall of the small tray. The upper element, which may be flat, is contained within the rim of the tray and, of course, also seals off the housing for the piece. For the practical obtention of the tray-shaped element it is preferable to employ an injection-molding process. The plastic material forming this tray-shaped element, which is usually transparent, may be selected from the group of materials consisting of polyvinyl chloride, acrylic resin, methacrylic resin and polycarbonate. Of course, the possibility of employing another method for producing the element is deemed to be within the purview of the invention.

For the sake of brevity, hereinafter, in the present specification, the term "hologram" is deemed to refer to an image which is micro-embossed on a metallized coating by a nickel cliche or printing block, which has been formed by the depositing of the metal on a photo-resist emulsion engraved by laser light. The technique of preparation of the holograms is known in the art. When the delaminable decorative hologram with its substrate or, alternatively, the decorative multi-ink printing layer which is also delaminable, is subjected to a mechanical force, even in a small amount, such as the pulling action exerted from the adhesive, it is delaminated, resulting in the image being torn into irregular segments, and therefore becoming visibly and irreparably lacerated. The delaminable hologram, or the delaminable decorative multi-ink layer, constituting the security printing pattern, which is inserted between the elements of the case and is bonded thereto by an adhesive at least along their respective edges, is imparted a significant irreparable laceration as soon as an attempt at opening is carried out on the case.

In summation, the safety case pursuant to the present invention provides for a guarantee over the authenticity of the therein enclosed piece or item, because it is counterfeit-proof per se; in essence virtually impossible to replicate, and it encloses the piece or item in a foolproof manner as long as the security printing seal is found to be in an intact condition.

The delaminable hologram, together with its support, is rendered adhesive through the application of a suitable adhesive matter on one or on both surfaces thereof.

Pursuant to an alternative embodiment of the invention, based on a decorative multi-ink layer which is anchored in a discontinuous manner to the lower element, the adhesive can be applied to the free face of the layer which is to be bonded to the upper element; otherwise, the adhesive can be applied on the upper element, to which the entire structure must adhere. In view of the handling of these elements, in order to close the safety case, and to be able to protect the hologram, a release paper is added to the adhesive face and is removed at the moment of the joining of the elements. The employed adhesive used must expediently be colorless. As a transparent adhesive it is preferably to employ an acrylic resin based adhesive.

In the present specification, the term "ingot" is deemed to define, hereinbelow, a piece having a weight generally not greater than 250 g and a thickness of generally less than 1 cm, which can be contained within the safety case.

For the sake of simplicity, the term "piece" also includes items such as a precious stone, a pearl, or a stamp possessing a philatelic value, and other types of objects which can be contained within the case; for instance, a pharmaceutical preparate, or a document, when such entities are deemed to possess an intrinsic value and their original properties are certifiable in an expedient manner. Furthermore, the expression "transfer primer", in particular, is defined as a layer of lithographic or silk-screen printing ink or varnish, which renders overlaid inks transferable, and which is preferably based on silicones or other components loosely adhered to the substrate. Finally, the term "anchored" defines a chemical or physical union between the coating layer and the substrate without any adhesives.

As is known in the art, a credit card generally has a flat shape; namely in the form of a rectangular quadrilateral with rounded corners, the standard size of which measured across the midlines, is at present approximately 85.7×54 mm. This may be the shape of the lower element and also of the upper element. The identification data of the piece, for numismatic or philatelic purposes, may refer to the applicable dealer, or bear decorative features. Additionally, pertinent certification data with signature are recorded, such as legends, codes, numbers, series, as well as metallic composition and content, size, dating, weight, face value, grading, carats and the like.

The identification and certification data are printed, in part on the transparent lower element which is shaped as a credit card, and can also be thermographically printed or punched thereon; while in part, they are visible as they are printed, for instance, lithographically or by silk screening, on the reverse of the upper element, and by virtue of the transparency of the material, on at least a portion of the lower element.

An intermediate covering of an opaque layer separates the two layers of decorative imprints and data which are visible on, respectively, the two faces of the case.

The upper element, due to its transparency, discloses on the upper face of the case a decorative design which is printed on the reverse of this element; for instance lithographically, and even in two colors, which design represents the symbol for the case itself. The foregoing is completely visible by virtue of the transparency of the upper element, and due to the presence of the underlying covering of an opaque layer which, for example, is printed in white colors.

With regard to the identification and certification data with signature it may be convenient to print these, instead of directly onto one or on both of the elements as indicated hereinabove, on a separate strip of paper or onto other kinds of material, which are introduced in the case before closing and sealing the latter. More precisely the strip may be numbered and crease-cut, can be applied after removing the release paper to the adhesive on the reverse of the lower element, and is visible to view because of said transparency of said element.

A safety case in the format of a credit card arouses in a potential purchaser and in the public, a sense of trust, security and confidence, which are correlated to the well-known format and graphic pattern of credit cards. The lower element, trimmed in the standard shape of a credit card, but not yet fastened to the upper element, can be marked by the dealer by means of the same punching and thermographic machines which the dealer employs for standard credit cards. An invisible holographic optical code can be incorporated in the hologram, which is only detectable in monochromatic laser light. Furthermore, an optical code with an invisible ink, and which is readable under ultraviolet light and which is delaminable, can be applied to the case, also in combination with the holographic code. Such an optical code may, in particular, assist in increasing the level of security of the seal against counterfeiting.

Alternatively, it is possible to apply a transfer hologram or another security device to the case.

The safety case which is provided with a security printing seal, can be applied at the sales counter, instead of the usual covers, to the uncirculated pieces, but is also widely applicable for a successive certification which is to be progressively imparted to the entire numismatic, philatelic or other kind of precious circulating material, when the individual pieces are presented to the counters of the dealer for sale, or when the bearers request the dealer for imparting the numismatic, philatelic or "precious" certification to their coins, medals, ingots, stones, pearls, stamps, and the like through the application of the safety case.

Collectors who are uncertain about the authenticity of one of their coins or pieces should take the precaution of having it authenticated and certified with permanent indication of its grading and fineness; all of the foregoing being attainable by having their piece confined in the safety case by the dealer.

In conclusion, the safety case pursuant to the present invention represents an excellent security packing producible at reasonable cost, which inseparably combines the piece which is packaged in the case at the locale of the transaction, into an unalterable or tamperproof and permanent certification of authenticity, and durably protects its integrity and quality.

It is evident that by means of the inventively conceived case there is largely eliminated any doubt as to the authenticity and quality of the piece, inasmuch as the qualities and properties thereof are now guaranteed in a direct and visible manner by the intact case itself. These properties of the safety case considerably enhance the commerce in gold coins, medals, small ingots, pearls, stamps and the like precious items which may be bought as gifts or for purposes of collection.

If desired, the relief or housing for the piece in the safety case may be composed of two complementary shells or cavities respectively formed in the upper and lower elements, so that the bulk and the shape of the piece is distributed between the shells or cavities.

As indicated hereinabove the lower element can also be in the form of a small tray with a niche for lodging the piece in its bottom wall, and such an element with the niche can be combined with an upper flat element; or alternatively, the upper element may be provided with a complementary shell or cavity.

The safety case may incorporate two or more housings, each of which being adapted to receive respectively, a single piece. Particularly suitable for this purpose is a safety case of a format which is larger than a credit card. Each of the piece-receiving housings is protected by the encompassing imprinted decorative layer as a security printing seal against counterfeiting.

BRIEF DESCRIPTION OF THE DRAWINGS

The invention will now be more clearly ascertainable from the following detailed description of exemplary embodiments, having reference to the accompanying drawings, in which.

DETAILED DESCRIPTION

Figure 2:
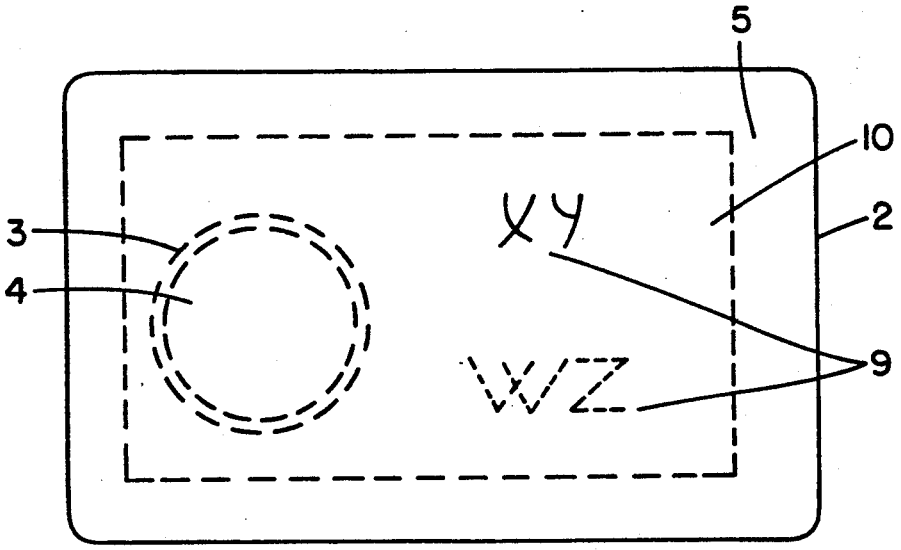
FIG. 2 illustrates a bottom plan view of the case.
Figure 3:
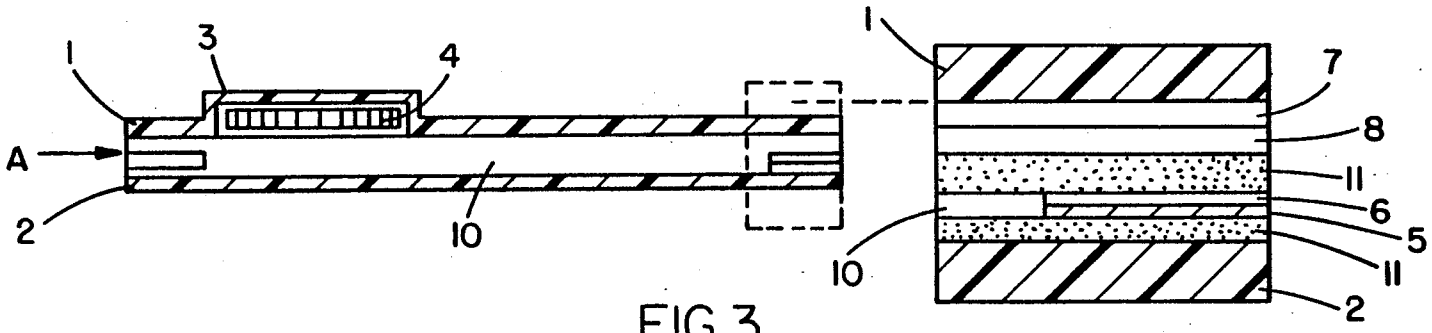
FIG. 3 illustrates a sectional view of the case taken along line I—I in FIG. 1, with enlarged details not shown to scale.

The case according to the invention is constituted by two superimposed jointed elements 1 and 2 which are constituted of transparent plastic material, and it encloses, for instance, a coin 4. The upper element 1 is provided with one relief or housing 3 which receives the coin 4, while the lower element 2 is flat. Both elements 1 and 2 are shaped in the form of a credit card. An optical code 16 with invisible ink and readable under ultraviolet light may be associated with the delaminable printing pattern. The body of the layers which is interposed between elements 1 and 2 is indicated with letter A in FIG. 3, which separately shows in an enlarged detail some particulars of the layers. Arranged between the two elements 1 and 2 is a decorative imprinted layer which, in FIGS. 2 and 3, is shown in the form of a hologram 5, which is delaminable since it is only loosely anchored to a specific substrate 6 of a plastic material; for instance, polyvinyl chloride.

Figure 1:
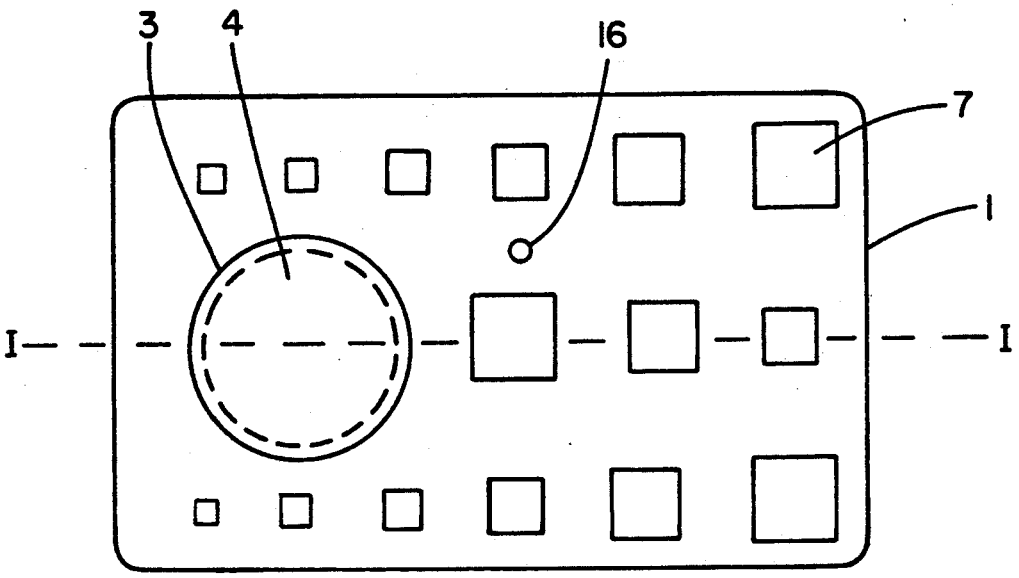
FIG. 1 illustrates a top plan view of the case from the side which is provided with the housing for the piece or precious item.

Element 1 with the housing thereon, has imprinted on its reverse side a decorative imprint 7, for example, by lithographic printing, possibly in two colors, illustrating the symbol of the case itself. From FIG. 1 there can be ascertained that this decorative imprint is composed of a plurality of squares. These squares may have a different color from the background, also comprised in imprint layer 7. Below layer 7 there is a layer of covering opaque material 8, so that the case symbol is transparently visible only to view from the face of element 1 containing the housing. Decorative imprints and identification and certification data with signature pertaining to the enclosed piece, all identified by 9 and shown in FIG. 2 by letters X,Y,W,Z, are applied by printing, for instance, lithographically or by silk-screening, on the white opaque covering layer 8.

Hologram 5, with its substrate 6, evidences a wide open space 10 in approximately a central location. Through this open space 10, there can be perceived all the decorative imprints, as well as the identification and certification data identified by 9, since they are visible through the transparency which, of course, permits the viewing of hologram 5.

The delaminable hologram 5 with substrate 6 is bonded to the upper element and to the lower element 2 by means of a transparent adhesive, indicated with reference numeral 11, and therefore forms a unitary body therewith.

Obviously, coin 4 is visible from both faces or sides of the case, because of a blank of printing and a corresponding transparent area which is also respected for the layers 7' and 8'. The imprinted decorative multi-ink layer 5' is irreparably delaminated responsive to the pulling action from the adhesive 11' which is exerted as soon as an attempt at opening is imparted to the case.

Figure 4:
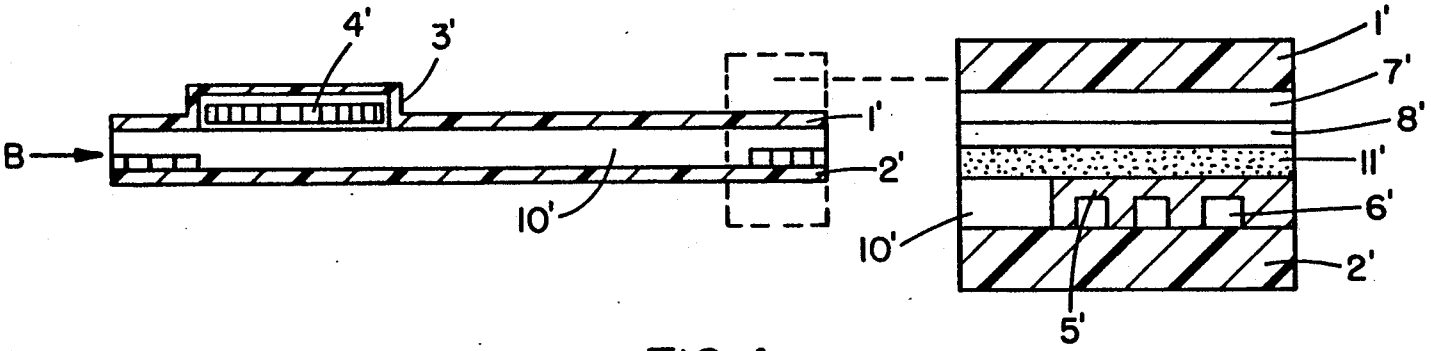
FIG. 4 illustrates a sectional view similar to FIG. 3, of a case according to an alternative embodiment, with enlarged details not shown to scale.

As it can be seen from FIG. 4, which shows an alternative embodiment of the invention, element 1' and element 2' enclose a structure of layers indicated by B. A decorative multi-ink layer 5' is anchored or adhered in a discontinuous manner, in portions, to the lower element 2' and possesses an open space 10' in approximately its central location so as to permit view of the decorative imprints, identification and certification data by the transparency of element 2'. The adherence of the delaminable ink layer 5' to element 2' is discontinuous, because some portions or locations are coated with transfer primer 6', which prevents such adherence. Element 1' with a housing 3' for a coin 4' has an ink printing on its reverse side, even in two colors, of a decorative pattern 7' representing a symbol for the case. This symbol is visible by transparency through element 1'.

An opaque covering layer 8' is applied below the imprint 7'. The adhesive 10' bonds the two elements 1' and 2' at least at their inner layers. The decorative ink layer 5' is delaminated responsive to pulling action by the adhesive 11' exerted thereon as soon as an attempt or opening is carried out on the case.

Figure 5:
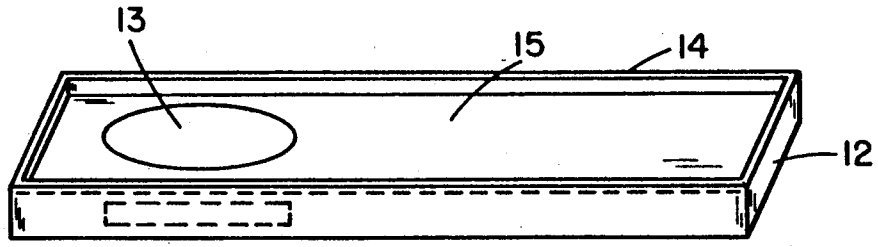
FIG. 5 illustrates a perspective view of the lower element of the case with the niche for the piece therein.
Figure 7:
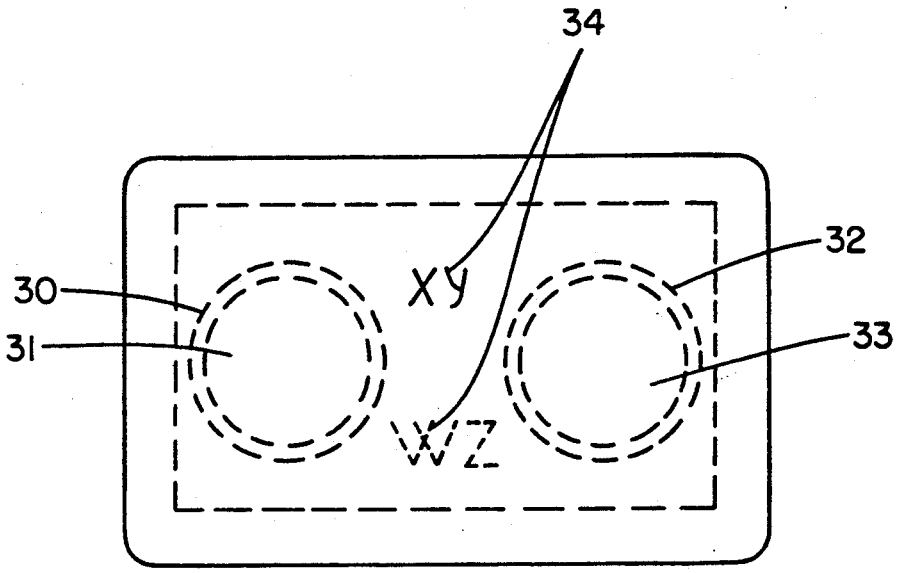
FIG. 7 illustrates a fourth embodiment of the invention.
Figure 6:
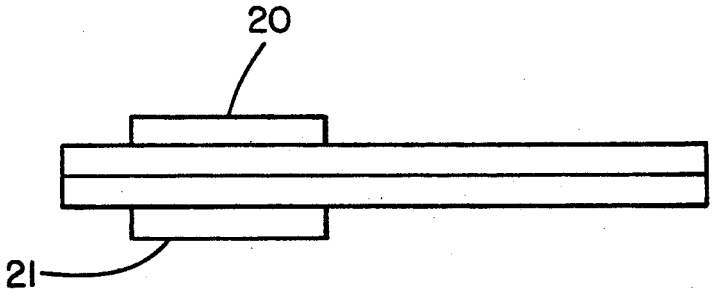
FIG. 6 illustrates a third embodiment of the invention.

FIG. 5 illustrates the tray-shaped lower element 12 with a housing 13 in the form of a niche. The element 12 is provided with a peripheral rim 14. Housing 13 for the piece is formed in the bottom wall 15. The upper element, not shown in this figure, must be located within and in contact with the perimeter represented by rim 14.

While there has been shown and described what are considered to be preferred embodiments of the invention, it will of course be understood that various modifications and changes in form or detail could readily be made without departing from the spirit of the invention. It is therefore intended that the invention be not limited to the exact form and detail therein shown and described, nor to anything less than the whole of the invention herein disclosed as hereinafter claimed.

What is claimed is:

1. A safety case for the containment and ensuring of the authenticity and condition of at least one valuable object, comprising in combination: a first transparent sheet-like plastic element; a second transparent sheet-like plastic element; at least one of said elements including at least one housing forming a shell for the object, said first element bearing an indelible graphic pattern on a surface thereof facing towards said second element which is visible by transparency and consists of images and data informative of the identification and certification of the object; an imprinted decorative multi-ink layer on a surface of said second element facing said first element, said imprinted decorative multi-ink layer including a security printing pattern and being anchored only to portions of the surface of said second element, a transfer primer on the remaining portions of said surface on said second element to inhibit local adherence of said ink layer to said surface portions; and an adhesive on said multi-ink layer in regions thereof encompassing said at least one housing and graphic pattern of said first element, whereby superposition of said second element on said first element causes said adhesive to form an adhesive bond therebetween providing a sealed containment for an object an in which delamination of said first element to form a visible irreparable laceration of the security pattern indicative of a tampering condition.

2. A safety case as claimed in claim 1 wherein said security printing pattern in said imprinted decorative multi-ink layer comprises a figure, a sign, a writing, a letter, a number or the like, singly or in combination with each other, or in random sequence.

3. A safety case as claimed in claim 1, wherein said case has the shape of a credit card.

4. A safety case as claimed in claim 1, wherein said first and second elements are each made of a material selected form the group consisting of polyvinyl chloride, polystyrene, polyester, polycarbonate, polypropylene and polyethylene.

5. A safety case as claimed in claim 1, wherein said adhesive is transparent.

6. A safety case as claimed in claim 1, wherein the decorative layer representing the delaminable security printing pattern is associated with an optical code with an ink which is invisible in white light but readable in ultraviolet light.

7. A safety case as claimed in claim 1, wherein the at least one housing for the object comprises two complementary shells, respectively formed in the first and second elements such that the bulk and the shape of the at least one object is fitted into the shells.

8. A safety case as claimed in claim 1, comprising a plurality of said housings each adapted to contain a single object, each said housing being protected by an encompassing imprinted decorative layer forming a seal against counterfeiting.

* * * * *

UNITED STATES PATENT AND TRADEMARK OFFICE

CERTIFICATE OF CORRECTION

PATENT NO. : 5,033,774

DATED : July 23, 1991

INVENTOR(S) : Giovanni Benardelli

It is certified that error appears in the above-identified patent and that said Letters Patent is hereby corrected as shown below:

Column 2, line 55: delete "- TM"

Column 8, line 37, Claim 1: after "of" insert --said elements by a separating pulling action exerted thereon transfers the non-anchored portions of said multi-ink layer by the overlying adhesive from said second element to--

Signed and Sealed this

Twentieth Day of October, 1992

*Attest:*

*Attesting Officer*

DOUGLAS B. COMER

*Acting Commissioner of Patents and Trademarks*